US007976440B2

(12) United States Patent
Webber et al.

(10) Patent No.: US 7,976,440 B2
(45) Date of Patent: Jul. 12, 2011

(54) UPPER BACK EXERCISE MACHINE WITH SELF-ALIGNING PIVOTING USER SUPPORT

(75) Inventors: Randall T. Webber, La Jolla, CA (US); Christopher E. Brennan, Santee, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 278 days.

(21) Appl. No.: 12/060,689

(22) Filed: Apr. 1, 2008

(65) Prior Publication Data

US 2008/0182732 A1 Jul. 31, 2008

Related U.S. Application Data

(62) Division of application No. 10/633,805, filed on Aug. 4, 2003, now Pat. No. 7,594,880.

(51) Int. Cl.
*A63B 21/00* (2006.01)

(52) U.S. Cl. ..... 482/95; 482/96; 482/53; 482/72

(58) Field of Classification Search ..... 482/95, 482/96, 52, 53, 72, 71
See application file for complete search history.

(56) References Cited

U.S. PATENT DOCUMENTS 2,145,940 A 2/1939 Marlowe
4,441,708 A 4/1984 Brentham
4,641,833 A 2/1987 Trethewey
4,743,010 A 5/1988 Geraci
4,790,530 A 12/1988 Maag
4,822,038 A 4/1989 Maag
4,844,456 A 7/1989 Habing et al.
4,917,379 A 4/1990 Maag
4,943,051 A * 7/1990 Haskins et al. ..... 482/72
4,944,641 A 7/1990 Habing
4,949,958 A 8/1990 Richey
5,236,406 A 8/1993 Webber (Continued)

FOREIGN PATENT DOCUMENTS

CA 2075331 2/1994

OTHER PUBLICATIONS

U.S. Appl. No. 12/212,090 of Webber et al. filed Sep. 17, 2008.

(Continued)

*Primary Examiner* — Jerome W Donnelly
(74) *Attorney, Agent, or Firm* — Procopio, Cory, Hargreaves & Savitch LLP

(57) ABSTRACT

An exercise machine has a main frame and a user support frame pivotally mounted relative to the main frame for rotation between start and end positions. The user support frame supports spaced positions on a user's body throughout an exercise movement. A user engagement device is movably mounted relative to the frames and has at least one handle gripped by the user in performing exercises, and a connecting linkage translates movement of the user engagement device to rotational movement of the user support frame. A load resists movement of at least one of the user support, user engagement device, and connecting linkage. The user engagement device is at least partially non-rigid to allow a user to define the path of the handle and thus the type of back exercise performed.

25 Claims, 3 Drawing Sheets

U.S. PATENT DOCUMENTS 5,254,067 A 10/1993 Habing et al.
5,330,404 A 7/1994 Lopeteguy et al.
5,330,405 A 7/1994 Habing et al.
5,342,270 A 8/1994 Jones
5,352,171 A 10/1994 Lin
5,354,248 A 10/1994 Rawls et al.
5,356,358 A 10/1994 Chen
5,401,227 A 3/1995 Webber
D357,041 S 4/1995 McBride et al.
5,417,634 A 5/1995 Habing
5,453,066 A * 9/1995 Richter, Jr. ..... 482/96
5,478,298 A 12/1995 Chen
5,486,150 A 1/1996 Randolph
5,498,222 A 3/1996 Hur
5,505,679 A * 4/1996 McBride et al. ..... 482/53
5,520,599 A 5/1996 Chen
5,527,243 A 6/1996 Chen
5,527,250 A 6/1996 Chen
5,533,953 A 7/1996 Lui et al.
D372,509 S 8/1996 Yang
5,547,444 A 8/1996 Huang et al.
5,573,482 A 11/1996 Wang et al.
5,580,340 A 12/1996 Yu
5,582,563 A 12/1996 Fan
5,616,105 A 4/1997 Wang
5,626,542 A 5/1997 Dalebout et al.
5,643,147 A 7/1997 Huang
D383,814 S 9/1997 Ward
5,669,865 A 9/1997 Gordon
5,674,161 A 10/1997 Lin
5,681,247 A 10/1997 Webber
5,683,334 A 11/1997 Webber
5,695,435 A 12/1997 Dalebout et al.
5,720,695 A 2/1998 Eckmann
5,722,918 A 3/1998 Lee
5,800,321 A 9/1998 Webber
5,810,698 A 9/1998 Hullett et al.
5,899,836 A 5/1999 Chen
5,916,072 A 6/1999 Webber
5,938,570 A 8/1999 Maresh
5,944,641 A 8/1999 Habing
5,961,427 A 10/1999 Habing et al.
5,961,428 A 10/1999 Webber
6,004,247 A 12/1999 Webber
6,030,322 A 2/2000 Webber
6,090,020 A 7/2000 Webber
6,135,930 A 10/2000 Kuo
6,142,914 A 11/2000 Crawford et al.
6,162,153 A 12/2000 Perez et al.
6,264,588 B1 7/2001 Ellis
6,312,366 B1 11/2001 Prusick
6,319,178 B1 11/2001 Webber
6,561,960 B2 5/2003 Webber
6,579,213 B1 6/2003 Webber et al.
6,605,024 B2 8/2003 Stearns
6,752,748 B1 6/2004 Scotti
6,811,522 B1 11/2004 McQuinn
6,855,098 B2 2/2005 Reitz et al.
6,916,278 B2 7/2005 Webber
6,971,978 B2 12/2005 Hyder
6,988,977 B2 1/2006 Webber et al.
7,052,444 B2 5/2006 Webber
7,052,446 B2 5/2006 Morris et al.
7,070,545 B2 7/2006 Lull et al.
7,141,003 B2 11/2006 Wu
7,141,008 B2 11/2006 Krull et al.
7,166,066 B2 1/2007 Webber
7,220,221 B2 5/2007 Mosimann et al.
7,223,213 B2 5/2007 Golesh
7,229,389 B2 6/2007 Hong
7,322,906 B2 1/2008 Webber
7,331,911 B2 2/2008 Webber et al.
7,335,140 B2 2/2008 Webber et al.
7,361,125 B2 4/2008 Webber et al.
7,384,381 B2 6/2008 Webber et al.
7,468,024 B2 12/2008 Webber et al.
7,553,263 B2 6/2009 Webb et al.
2002/0013199 A1 1/2002 Giannelli et al.
2002/0183173 A1 12/2002 Abelbeck
2002/0187879 A1 12/2002 Ball et al.
2003/0199362 A1 10/2003 Chamberlin
2005/0032611 A1 2/2005 Webber et al.
2006/0247107 A1 11/2006 Carter
2006/0276313 A1 12/2006 Hong
2007/0232462 A1 10/2007 Webber et al.
2007/0232467 A1 10/2007 Puzey
2007/0293377 A1 12/2007 Webber et al.
2007/0293378 A1 12/2007 Webber et al.
2008/0058176 A1 3/2008 Webber et al.
2008/0132389 A1 6/2008 Webber et al.
2008/0153677 A1 6/2008 Webber et al.
2008/0214365 A1 9/2008 Webber
2008/0214367 A1 9/2008 Webber et al.
2008/0220950 A1 9/2008 Webber et al.
2008/0234110 A1 9/2008 Webber et al.
2008/0242517 A1 10/2008 Webber et al.
2008/0248929 A1 10/2008 Webber et al.

OTHER PUBLICATIONS

Office Action dated Aug. 22, 2008 in U.S. Appl. No. 11/846,437.
Hoist Prime 8 Brochure, Hoist Fitness Systems, 2000.

* cited by examiner

UPPER BACK EXERCISE MACHINE WITH SELF-ALIGNING PIVOTING USER SUPPORT

RELATED APPLICATION

The present application is a Divisional of co-pending U.S. patent application Ser. No. 10/633,805 filed on Aug. 4, 2003, the contents of which are incorporated herein by reference in their entirety.

BACKGROUND

1. Field of the Invention

This invention relates generally to exercise machines, and is particularly concerned with an upper back exercise machine with a pivoting user support.

2. Related Art

There are several different types of exercise for exercising upper back muscles, including rear deltoid and mid row exercises. These exercises can be difficult for many people to perform using free weights, requiring balance and coordination as well as strength to follow the proper movement path. Improper form by the exerciser can make the exercise more difficult, increase stress on the joints, and even lead to possible injury.

Various exercise machines have been developed for performing upper back and other exercises. Some of these have a stationary user support, while others have a pivoting or movable user support, which may or may not be linked to the exercise arm or user engagement means. One problem in most or all prior art designs is the unnatural and exaggerated arcing movement found in pivoting arm exercise machines, which do not accurately simulate the natural body movement found in free weight and/or free bar exercises.

Movable user supports linked to the movement of an exercise arm are extremely common in exercise machines for performing many different exercises, and are generally known as composite motion exercise machines. U.S. Pat. No. 2,252,156 of Bell and U.S. Pat. No. 6,251,047 of Stearns show bicycle and exercise bike designs in which a seat or user support is linked to an exercise arm or crank and pedal system to provide up and down movement to the seat. The most common application of movable user supports is found in rowing and horse riding type exercise machines, which use the weight of the user as the exercise resistance. In U.S. Pat. No. 3,446,503 of Lawton, U.S. Pat. No. 4,743,010 of Geraci, and U.S. Pat. No. 5,342,269 of Huang, a seat and exercise arm are pivotally mounted on the base frame, with the seat linked to the exercise arm for dependent movement. U.S. Pat. No. 4,300,760 of Bobroff, U.S. Pat. No. 5,299,997 of Chen, U.S. Pat. No. 5,356,357 of Wang, U.S. Pat. No. 5,453,066 of Richter, U.S. Pat. No. 5,458,553 of Wu, U.S. Pat. No. 5,503,608 of Chang and U.S. Pat. No. 5,507,710 of Chen all show horse riding type exercise machines. They all consist of a user support pivotally attached to a base frame, and one or more exercise arms pivotally connected to the frame and pivotally linked to the user support.

U.S. Pat. No. 6,264,588 of Ellis shows a composite motion movement machine that has a moving exercise arm linked to a movable user support, and a pivoting truck system which is slidably connected to rails mounted both on the main frame and user support. The movable user support and exercise arm are both pivoted at the same point on the base frame, in front of the user support. A belt connects the exercise arm to the truck. When the exercise arm is pushed or pulled, the belt pulls the truck along the rails, forcing the user support to rotate about its pivotal connection to the frame. This design puts all of the user's weight on one side of the pivot, producing a high initial lifting resistance when the user starts the exercise, and also has no means for properly aligning the exercise arm and user support during the exercise movement.

Movable seats linked to exercise arms have also been used in multi-purpose exercise machines, such as U.S. Pat. No. 5,330,405 of Habing, U.S. Pat. No. 5,334,120 of Rasmussen, U.S. Pat. No. 5,669,865 of Gordon, U.S. Pat. No. 5,733,232 of Hsu, and U.S. Pat. No. 6,244,995 of Prsala. In U.S. Pat. No. 5,330,405 of Habing, a lever arm is pivotally connected to the base frame and supports a movable sub-frame including a user support which is also pivotally connected to the stationary base frame. An exercise arm is pivotally mounted on the sub-frame and linked to the lever arm via cables and pulleys, so that movement of the exercise arm pulls the cables lifting the lever arm, and causing the sub-frame to pivot about its connection to the base frame and rise against the weight of the user. U.S. Pat. No. 5,733,232 of Hsu shows another multi-purpose exercise machine with a pivoting seat, but in this case the back pad is stationary and only the seat pad is pivoted. Thus, the seat travels in an arcuate path without any secondary stabilization for the user, forcing the user to try to maintain their balance on the seat as it arcs upward. Also, in this design, the pivot point for the seat is located at a spacing behind the user position, so that all of the user's weight opposes the user when starting an exercise from rest. Neither of these machines has any capability for aligning the user and user support with a rigid exercise arm, and thus do not maintain or support the user in the proper position throughout the exercise.

Gordon shows a multi-purpose exercise machine that has a hinged, two-piece user support that folds and unfolds with each exercise repetition. The user support consists of a seat portion and a backrest portion, which are pivotally connected together. The user support is pivotally connected to a main frame, as is a first exercise arm. This first exercise arm provides pressing and pulldown exercises. A second exercise arm is pivotally connected to the user support for providing leg exercises. This second arm travels with the seat portion of the user support. A connecting link pivotally connects the first exercise arm with the user support so that movement in the arm forces movement in the user support. The link connects to the user support at the same pivot that joins the seat portion with the backrest portion. In a second embodiment a flexible line connects the user support with the main frame and has user-engaging handles attached to one end so that movement to the handles results in movement to the user support. In this design, the flexible line acts as both connecting link and exercise arm. In both designs, the seat and backrest do not travel in a fixed relationship to each other and additional support such a footrest, safety belts and thigh gripping surfaces are required to keep the user properly and safely positioned in the user support. Because most of the combined weight of the user and user support remain on one side of the user support's gravitational centerline, this weight is used as partial exercise resistance. Movement of the user support is designed to be an exercise of its own, rather than providing proper positioning/alignment of the user relative to the exercise arm. The folding and unfolding of the two-piece user support constantly works the abdominal and low back muscles, which means that these muscles are being worked even when other exercises are being performed. The user cannot truly isolate any one specific muscle or muscle group. The stomach cannot be worked without working the low back, the arms, chest, shoulders, upper back and legs all must be worked with one another or at the least with both the stomach and low back. Because of this the user cannot fully fatigue other muscles as the abdominals and low back would fatigue first.

Current exercise machines with pivoting or movable user supports often do not accurately maintain proper positioning of the user throughout the exercise motion, can result in awkward hand or wrist positions, and often involve exaggerated and unnatural arcing movements, or linear, non-arcing arm movements, rather than the smaller elliptical movement associated with free weight or natural exercise movements. There is no provision for proper positioning of the user relative to the position of the user engaging portion of the exercise arm throughout the entire exercise motion. Often, an awkward starting or finishing position is required, potentially causing strain or injury.

SUMMARY

Embodiments described herein provide for an upper back exercise machine with a pivoting user support.

An upper back exercise machine in one embodiment comprises a floor engaging main frame, a user support frame pivotally associated with the main frame, a user engagement device movably mounted on one of the frames for actuating by a user in order to perform an upper back exercise, and a connecting linkage which links movement of the user engagement device to movement of the user support. A load provides resistance to movement of the user support frame, user engagement device and/or connecting linkage. The connecting linkage and pivot mounts are arranged so that movement of the user engagement device results in self-aligning movement of the user support.

The user support frame in an exemplary embodiment has both a primary user support, such as a seat pad or back pad, and a secondary user support, such as a back pad, shoulder pad, thigh hold-down pads, chest pad, or the like. It may also have a supplementary stabilization means such as a foot rest, which is suitably mounted on, and travels with, the user support frame. This provides additional stabilization to the user, helping them to maintain a proper exercise position and providing additional comfort and support. The use of multiple support pads on the user support frame helps to position the exerciser properly and safely. These supports are in fixed alignment to each other and travel together, keeping the user in the same braced position throughout the entire exercise range of motion. This allows the user to focus on the exercise rather than worrying about their positioning on a moving platform or seat.

The exercise arm or user engagement device is movably mounted on the main frame, the user support frame, or the connecting linkage. The connecting linkage translates movement of the exercise arm to movement of the user support, and is movably engaged with at least two of the main frame, exercise arm, and user support. In one embodiment, the user engagement device is movably mounted on the main frame and associated with the connecting linkage. The user support and exercise arm may both be moveably mounted on the frame, with the connecting linkage connected between them. In another arrangement, the exercise arm may be pivotally mounted on the user support while the connecting linkage extends between the exercise arm and frame, such that movement of the exercise arm forces the user support to pivot.

The user support frame may be pivoted on the base of the main frame so that it is relatively low to the ground and readily accessible to the user in entering and exiting the machine. A pivot assembly which pivotally supports the user support frame may be located beneath the frame. The connecting linkage may be rigid, flexible, or partially flexible, and may be adjustable in length or position. The user engagement device or exercise arm may have one or two handles. If handles are provided, they may be rigid or flexible, fixed or self-aligning, and may provide two dimensional or three dimensional hand movement.

In one embodiment, the user engagement device comprises one or more flexible or articulated user engaging arm portions which allow the user to control the movement path and thus determine the type of exercise performed. The handles and associated arm portions may be movable independently or in unison. The user engaging portions may be flexible elongate members or articulated members extending from the handles and associated with the connecting linkage. In one embodiment, the user engagement device and connecting linkage are both movably associated with the main frame. The user engagement device may be a bi-directional exercise arm.

The user engagement device in one embodiment comprises a single flexible elongate member or cable which has a first end connected to a first handle and extends in a path including a swivel pulley assembly on the frame to a second handle. The swivel pulley assembly has two sets of independently pivoted pulleys which allow each handle engaging portion of the cable or elongate member to swivel inwardly and outwardly independently of the other handle engaging portion. This allows the user to determine the handle travel path from the start to the end position of the exercise, and thus the type of exercise and the back muscles used in the exercise.

In one embodiment, the primary support is a seat pad which is horizontal or slightly reclined in an exercise start position, and which is inclined forwardly in the exercise end position. The secondary support may comprise an upright support pad for the user's back or chest. Because the user support moves in conjunction with the exercise arm or user engagement device, the arcuate path of the exercise arm relative to the user support is reduced. The result is a more natural feeling exercise movement that more closely replicates the movement found in the corresponding free weight exercise.

The pivot mounting of the user support defines a vertical gravitational center line of the pivotal movement, and in one embodiment portions of the combined weight of the user and user support frame are positioned on both sides of the vertical gravitational center line in at least one of the start and end positions of the exercise. In one embodiment, a portion of the combined weight of the user and user support is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "drop-off" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the gravitational center line of the pivoting movement, resulting in either a high initial lifting resistance, or else a resistance "drop off" at the end of the exercise.

The exercise resistance or load may comprise a weight stack, weight plates mounted on pegs, or other types of resistance such as hydraulic, pneumatic, electromagnetic, or elastic bands, and may be associated with any of the moving parts, i.e. the user support frame, exercise arm, or connecting linkage.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an upper back exercise machine having an exercise arm or user engagement device and user support which travel in a dependent relationship. The user engagement device has handles which are gripped by the user and flexible or articulated arm portions linking the handles with a connecting linkage which translates movement of the handles into movement of the user support.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
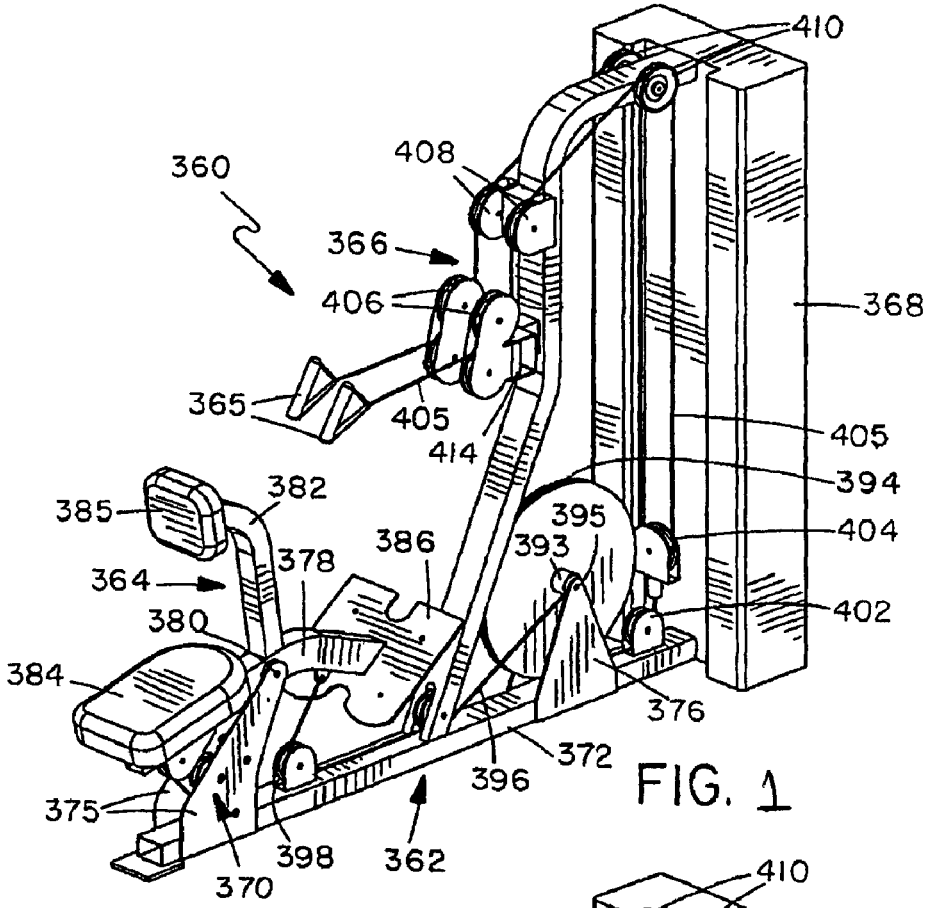
FIG. 1 is a front perspective view of an upper back exercise machine according to one embodiment, with the machine illustrated in a start position adopted at the beginning of an exercise movement.
Figure 2:
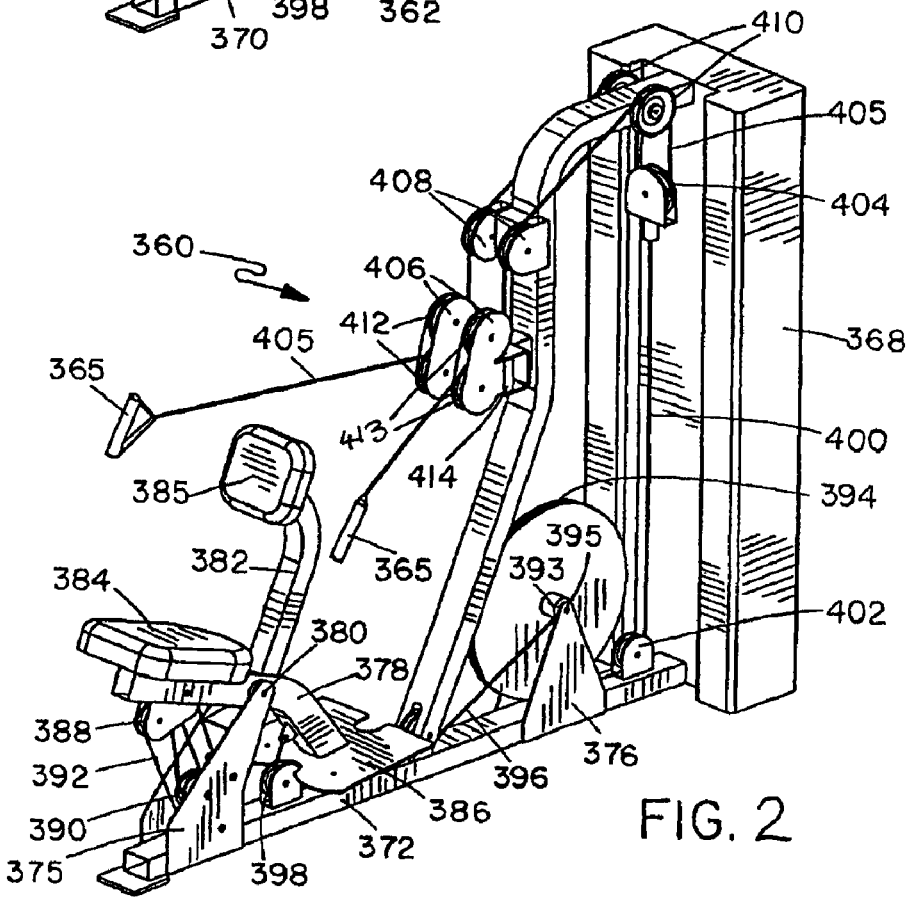
FIG. 2 is a front perspective view similar to FIG. 1, illustrating the machine in an exercise ending position.
Figure 3:
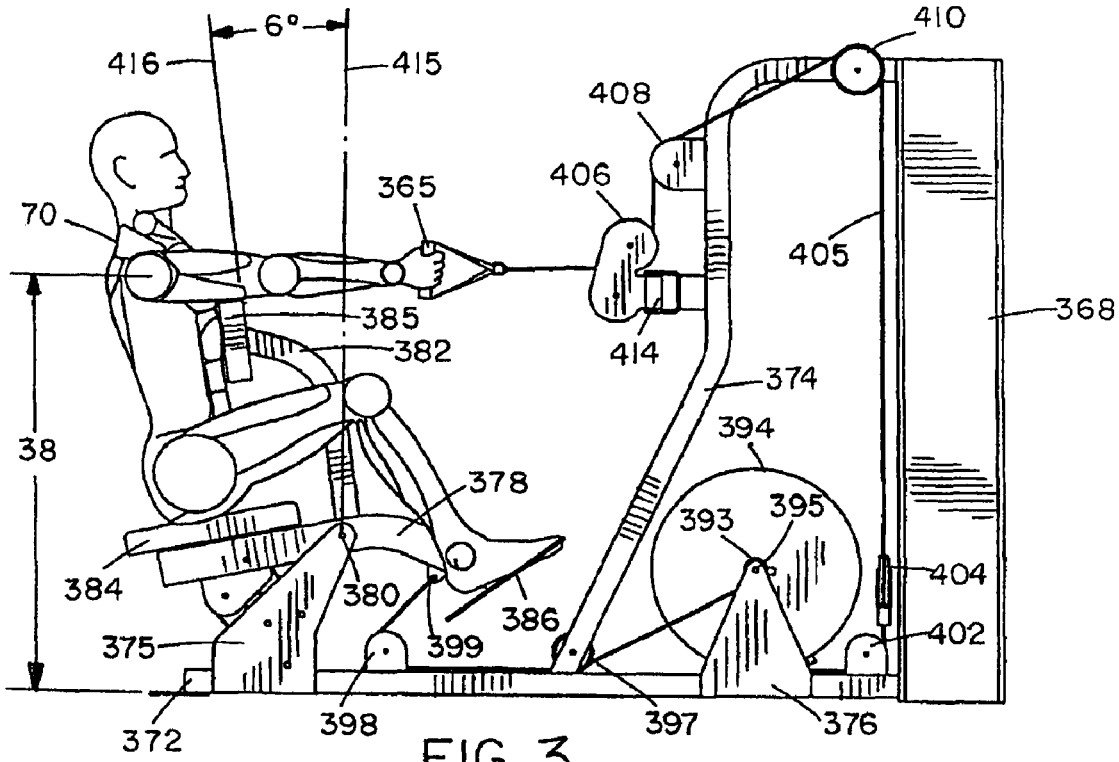
FIG. 3 is a side elevation view of the machine of FIGS. 1 and 2, with a user seated on the machine in the start position adopted at the beginning of the exercise.
Figure 4:
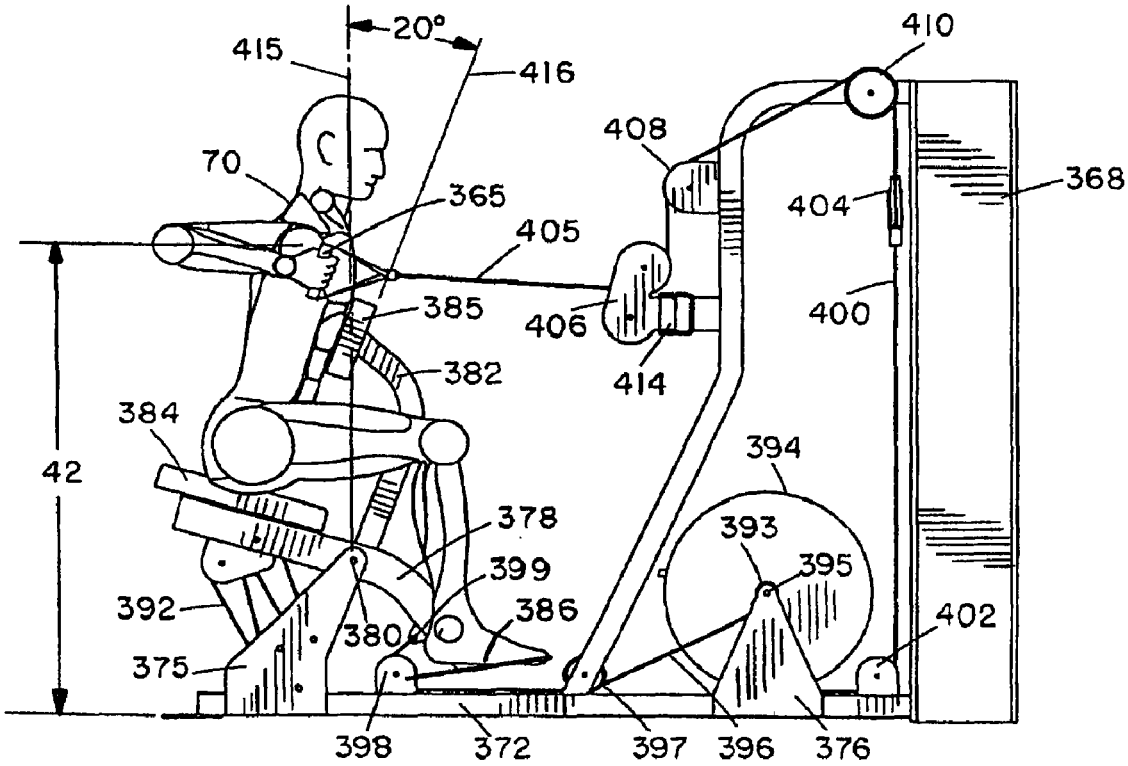
FIG. 4 is a side elevation view similar to FIG. 3, illustrating the user and machine in the end position of the exercise.

FIGS. 1 to 5 illustrate an upper back exercise machine 360 according to one embodiment. FIG. 1 illustrates the machine in a start position while FIG. 2 illustrates the machine in an end position for the exercise, with FIGS. 3 and 4 illustrating the same start and finish positions with a user seated on the machine.

The machine 360 has a main frame 362 and a user support frame 364 pivotally mounted on the main frame. A user engagement device is movably mounted relative to the frames and comprises user engaging handles 365 attached to opposite end portions or arm portions of a cable or flexible exercise arm member 405. The cable or flexible member extends around a series of pulleys in cable and pulley assembly 366. Any suitable flexible elongate members such as cables, belts, lines, chains and the like may be used for flexible exercise arm member 405. An exercise resistance comprising a weight stack in housing 368 is linked to the user support frame via a second cable and pulley assembly 370. A connecting linkage extends from the user engagement device to the user support frame. In this embodiment, the connecting linkage comprises a dual cam assembly 393, 394 and first and second cables or flexible links 400, 396 extending between cable 405 of the user engagement device and a forward end of the user support frame, as explained in more detail below. The flexible links 400, 396 may comprise any suitable flexible elongate members such as cables, belts, lines, chains and the like. Other connecting linkages may be used in alternative embodiments to link movement of the user engagement device to movement of the user support, such as cable and pulley linkages without cams, one or more rigid links, a sliding linkage system, or the like.

The main frame 362 comprises a horizontal base section 372, an upright section 374, user support pivot mount plates 375 extending upwardly at the rear end of the base section, and a pair of cam pivot mounting plates 376 extending upwardly from the base section between the upright section 374 and the weight stack housing 368.

The user support frame 364 is generally T-shaped, with a base 378 pivotally mounted between the upper ends of the pivot mount plates via pivot pin 380, and an upright post 382 which curves rearward at its upper end. A user support seat pad 384 is mounted on the rear part of the base, while a chest support pad 385 is mounted at the upper end of post 382. A foot support or footplate 386 is secured to the forward end of the base 378. The rear part of the base 378 is linked to the weight stack via the second cable and pulley assembly 370. As best illustrated in FIG. 2, cable and pulley assembly 370 comprises a set of pulleys 388 mounted on the undersurface of base 378, a set of pulleys 390 mounted between the pivot mounting plates 375, and a cable 392 extending from an anchor back and forth over the two sets of pulleys, and then running through the base 372 into the weight stack housing where it extends over further pulleys (not visible in the drawings) before linking in any conventional manner with the weight stack.

The forward end of the user support frame is linked to the user engaging handles via the connecting linkage 396, 393, 394, and 400, and the first cable and pulley assembly 366. The connecting linkage includes first and second cam portions 393,394 of different profiles mounted on a pivot shaft 395 rotatably mounted between the upper ends of cam plates 376. The forward end of the user support base 378 is linked to the first, smaller cam 393 by a cable 396 extending from the cam around a pulley 397 at the lower end of upright 374, around a second pulley 398 on the frame base beneath the user support base, and tied off at anchor 399 on the underside of the base 378 close to the footplate 386. A second cable 400 extends from the second, larger cam 394 around a fixed pulley 402 at the forward end of base 372 and is anchored to the housing of a floating pulley 404.

As noted above, the user engagement device in this embodiment comprises the handles 365 and flexible cable or other elongate member 405 which has opposite ends secured to the respective handles 365. Cable 405 extends in a path around pulleys on the main frame and around the floating pulley 404 to link the handles 365 with the connecting linkage. Cable 405 extends from one handle between pulleys 412 of one set of a pair of swivel pulley assemblies 406 mounted on upright 374, around one of a pair of fixed, side-by-side pulleys 408 on the upright above the swivel pulley assemblies 406, then around one of a pair of parallel pulleys 410 on opposite sides of an upper, generally horizontal portion of the upright 374, and then downwardly around the floating pulley 404. From the pulley 404, cable 405 extends back up around the second one of the pulleys 410, around the second one of the pulleys 408, and is then reeved between the two pulleys 413 in the second set of the swivel pulley assemblies 406, before connecting to the second handle 365. With this arrangement, rearward movement of one or both handles pulls up the floating pulley 404, rotating the cams 393,394. Cables 396 and 400 are oppositely connected to the respective cam portions 393 and 394 so that pulling on handles 365 unwinds cable 400 from cam portion 394 while winding cable 396 onto cam portion 393, rotating the user support frame about pivot 380.

Figure 5:
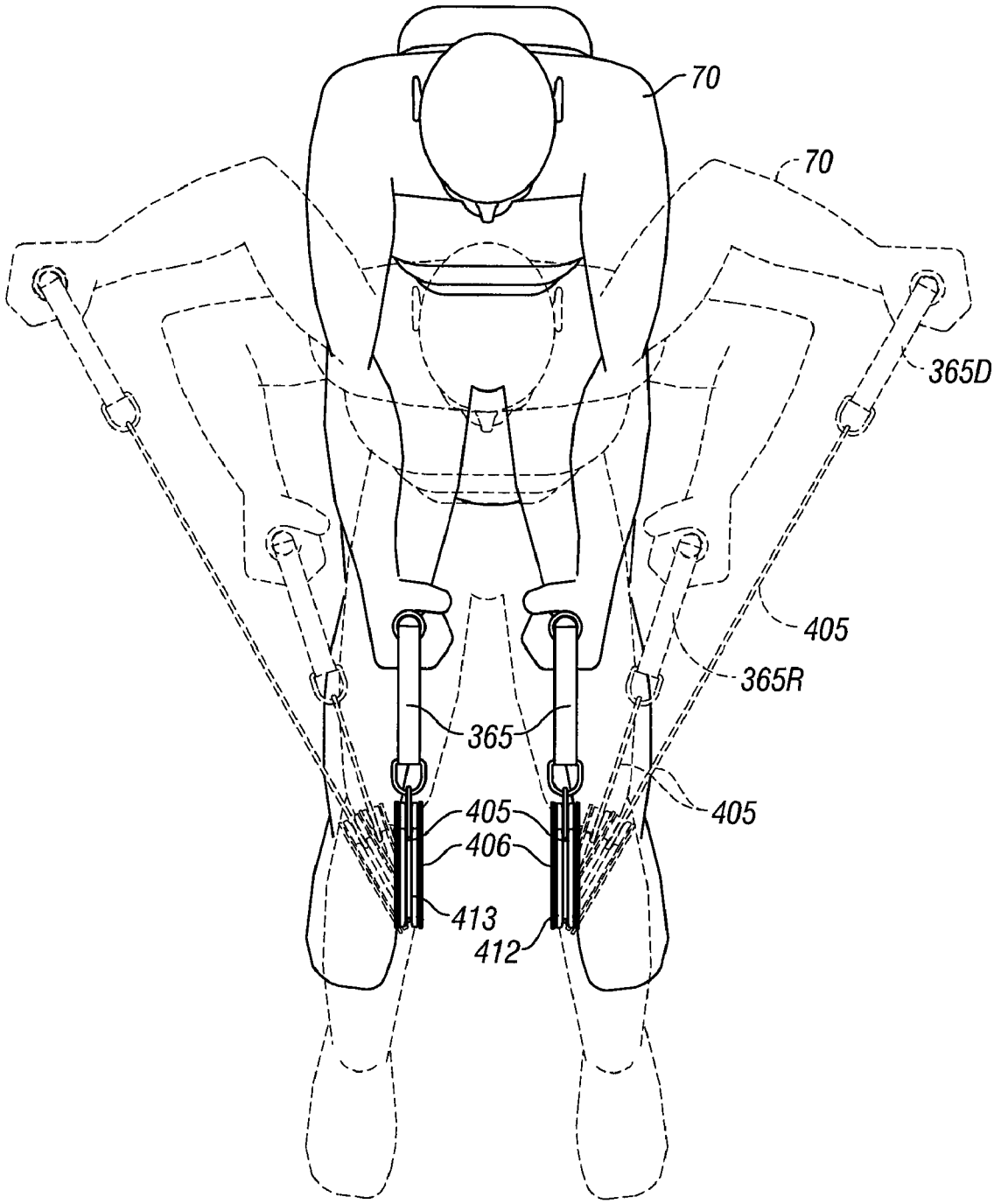
FIG. 5 is a top plan view of part of the user engaging handle part of the machine of FIGS. 1 to 4, with a seated user engaging the handles, illustrating user defined movement of the handles to perform different upper back exercises.

The swivel mounts 414 of the two swivel pulley assemblies 406 allow the assemblies to pivot in and out as indicated in FIG. 5 as the user moves their hands in an exercise movement which exercises the upper back muscles. This allows the user to control the exercise path, as indicated in FIG. 5 and described in more detail below. In order to perform the exercise, the user 70 first sits on the user support in the position of FIG. 3 and the solid line position of FIG. 5, placing their feet on the footplate 386 and their chest against the chest pad 385, then grabs the handles 365 with their arms straight in front of their body, slightly bent, and their hands close together, as indicated in FIG. 3 and in solid lines in FIG. 5. At the start of the exercise, the user is in a slightly reclined orientation at an angle of around 6 degrees to the gravitational centerline 415 or vertical centerline of the user support pivot 380, as indicated in FIG. 3, where the second dotted line 416 indicates the orientation of the chest pad 385 or front of the user's chest.

From the position illustrated in FIG. 3, the user pulls the handles or hand grips 365 rearward. Since the exercise arm in this embodiment is a flexible cable or other elongate member 405 which extends from each handle between pulleys of a respective swivel pulley assembly 406 which can swivel inward and outward independently of the other swivel pulley assembly, the user controls the exercise path and thus the type of upper back exercise performed. In FIGS. 3 and 4, the user is shown performing a rear deltoid exercise in which the user moves their hands rearward and outward into an end position in which the user's arms are bent with their hands positioned out to the sides of their body, as illustrated in the outermost dotted line handle position 365D of FIG. 5. As noted above, this movement also pulls the user support upwardly against the exercise resistance, with the chest pad and user upper body ending up in a forward lean of around 20 degrees from the vertical. The user's arms finish in a bent position with their hands positioned out to the sides, slightly below and forward of their shoulders.

The user is in three different positions throughout the exercise, starting in a recline or decline position, traveling through a straight, upright position, and ending in a forward incline position. At the same time, there is a change in elevation of the user's shoulders between the start and finish position, which amounts to about a four inch change. Additionally, the user can determine the travel path of the user engaging handles or grips 365. These factors together provide an enhanced workout by involving a greater number of muscles than a rear deltoid exercise performed in only one position, thereby combining multiple exercises into one. Instead of performing a rear deltoid exercise, a user may chose to perform a mid-row type of exercise, pulling their hands back and only slightly outwards, with the handles or grips 365 ending in dotted line position 365R of FIG. 5. Since cable 400 is not pulled as far when the mid row exercise is performed, the end position of the user support for this exercise is slightly different from that of FIG. 4, and is at a slightly smaller forward inclination than that illustrated. The user may define the travel path of the grips as desired throughout the exercise and may end the exercise with the handles in either of the positions illustrated in FIG. 5, or in any other desired position, so that different back muscles can be exercised.

The gravitational centerline or vertical centerline 415 of the user support pivot runs through the exerciser's thigh, just behind the knee in the start position and ending at mid thigh in the finish position of the rear deltoid exercise illustrated in FIGS. 3 and 4, with a slightly different end position when a user performs a mid row exercise. In either case, there is a balanced distribution of weight on each side of the centerline 415 both at the start and end position, minimizing the effect that the weight of the exerciser and user support has on the exercise resistance. The amount of weight positioned on each side of centerline 415 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

The connecting linkage 396, 393, 394, 400 which translates movement of the user engagement device into movement of the user support frame is partially flexible and includes at least two axially spaced cams or cam portions rotatably mounted about the same cam axis 395, arranged so that one cable or flexible link wraps around one of the cam portions while the other unwraps. Pulling on the handles or grips 365 in this machine rotates the dual cam assembly in a first direction (anti-clockwise as viewed in FIGS. 3 and 4), unwinding cable 400 from the larger cam 394, while winding a smaller amount of cable onto the smaller cam 393. Cams or separate cam portions of different relative diameters or profiles can be selected in order to change the ratio between handle movement and user support frame movement, depending on the desired end position for the user support frame.

In this embodiment, the user engagement device comprises handles attached to a flexible line or cable 405, to provide a unilateral, three dimensional user defined exercise motion. In an alternative embodiment, the handles may be attached to articulating arms to produce a similar user defined exercise motion. The machine is designed to mimic the natural elliptical movement of the corresponding free weight dumbbell exercise, but is able to combine the effectiveness of multiple exercises by rotating the user from reclined to flat to inclined positions throughout the exercise.

In each of the above embodiments, the user engagement device is linked to the user support so that movement of the user engagement device produces movement in the user support. The user engagement device is at least partially non-rigid, and the user can define the path of the handles of the user engagement device so as to perform different types of upper back exercise. The connecting linkage translates movement of the user engagement device to movement of the user support, and may be movably engaged with at least two of the main frame, user engagement device, and user support. In the illustrated embodiment, the connecting linkage is associated with all three of the user engagement device, user support, and main frame. The connecting linkage may be a partially flexible linkage including at least one dual cam or multiple cam portions which may be of different diameter or profile, but alternative connecting linkages may be used in other embodiments, such as rigid links, articulated links, completely flexible links, and the like, and the connecting linkage may be made adjustable.

In one embodiment, the user engagement device includes a flexible cable extending around pulleys on the main frame, but other user engagement devices allowing for user defined movement of gripping handles may be used in alternative embodiments, such as articulated exercise arms. In other embodiments, separate flexible elongate members or cables may be associated with each handle. The user engagement device may comprise any suitable flexible elongate member or members, such as cables, belts, lines, chains and the like The handles may be rigid or flexible, and may provide for two-dimensional or three-dimensional hand movement. The user engagement device is movably mounted on the main frame and linked to the connecting linkage in the illustrated embodiment, but may alternatively be mounted on the user support or the connecting linkage.

In each of the above embodiments, movement of the user support is linked to movement of the exercise arm or user engagement device, and the gravitational centerline of the user support's pivotal movement is positioned so that the combined weight of the user support and user is distributed on both sides of the gravitational centerline in at least one of the exercise start and end positions. Because of this arrangement, the user support provides a counter-balancing effect on the exercise arm as it moves and its weight is re-distributed. This balanced weight distribution positions a portion of the user and user support on each side of the gravitational centerline in either the start or end position, or both the start and end position. As the exercise arm is moved, a portion of this combined weight passes through the gravitational centerline redistributing the weight. This re-distribution is gradual and continuous throughout the exercise motion and is not noticed by the user.

In the exercise machines described above, operation of the user engagement device causes a rocking movement of the user support. Due to the position of the user support pivot, the movement of the user and user support has only a small effect on the exercise resistance felt by the user, and there is no high resistance to be overcome in starting the exercise, or large resistance drop-off. The rocking movement of the user support recruits core stabilizing muscles and also makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

It should be understood that all the different elements used in the various embodiments may be mixed and interchanged with one another, and different types and forms of components could be used without affecting the scope of the invention. Cables could be replaced with belts, ropes, chains, or the like, and pulleys could be replaced with sprockets. The seat and/or back pad could be fixed or made adjustable. Various different types of user engaging pads can be used. The exercise arm or user engagement device could be unidirectional or bi-directional, and may be in one piece (dependent) or two pieces for independent arm movement. The exercise arm may be mounted on the user support, main frame, or connecting linkage, and the exercise arm movement may be rotational or linear.

The user support and user engagement device could be designed to travel in the same or opposite directions. The user support pivot mount may have a single pivot or multiple pivots, and in the latter case the user support pivots about a theoretical pivot mount of the combined pivotal motion. Any of the various embodiments could have the resistance associated with any of the moving parts (user support, user engagement device, or connecting linkage). The exercise resistance may be a weight stack linked to part of the apparatus by a cable and pulley arrangement, or may be weight plates. Any other type of resistance known in the art may alternatively be used, such as hydraulic, pneumatic, electromagnetic, or elastic bands, in place of the weight stack or weight plates.

Although the exercise machine described above is a single, stand-alone exercise station, it may be incorporated as one of the exercise stations in a multi-station exercise machine. The multiple user supports provide secure and safe positioning, placing the user in the proper exercise alignment from start to finish, without any adjustment required by the user. The seat and upper body support (chest pad or back pad) travel together in fixed alignment to keep the user in the same position throughout the exercise motion so that the user does not have to worry about balancing on a moving platform or pad. Additional supports or foot plates which also travel with the user support provide a rest for the user's feet during travel of the user support, for added stability.

In each case, the user support is positioned relatively low to the ground in the start and end position, making the machines quicker, easier, and safer to enter and exit. The user does not have to climb up or down in order to get into, or out of, the exercise position. The low profile also makes the machines more economical to produce and less intimidating to the user. The user's position is continuously adjusted throughout the exercise from a slight rearward lean, through an upright position, and ending in a forward lean. This results in involvement of more back muscles than would be involved in a corresponding upper back pulling exercise where the exerciser remained in the same position throughout the exercise. The combined exercise arm and user support movement produces an automatic and continuous self-aligning exercise motion that allows enhanced hand and wrist positioning versus free weight and free bar exercises or prior art machines for performing equivalents of such exercises.

The user support has both a primary user support and a secondary user support which travel together during the exercise movement, and also has an additional user support in the form of a foot plate or foot rests to provide additional stabilization. This helps to maintain a proper exercise position throughout the exercise so that the user feels secure on the moving user support.

Although the exercise machine described above is designed for performing upper back exercises such as rear deltoid and mid row exercises, it may alternatively be arranged for performing different types of exercise. If the user faces in the opposite direction on the user support of FIGS. 1 to 5 and pulls the handles in the reverse of the movement of FIG. 5, i.e. from a position adjacent their body to a forwardly extended end position with their arms extending straight forward, a pec fly-like exercise may be performed. If the cable or flexible elongate member extends around pulleys located above the user support and is suitably linked to the connecting linkage, pull down types of upper body exercise may be performed.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An upper back exercise machine, comprising:

a floor-engaging main frame having a forward end and a rear end;

a user support frame pivotally mounted relative to the main frame for rotation between exercise start and end positions;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably mounted relative to the frames for engagement by the user in performing exercises;

a connecting linkage which translates movement of the user engagement device to movement of the user support frame;

the user engagement device having at least one handle which is gripped and pulled by the user in performing an upper back exercise, and at least one arm portion extending from the handle and associated with at least one of the main frame, user support frame, and connecting linkage;

the arm portion being at least partially non-rigid to allow user-defined motion of the handle in performing an upper back exercise;

the user support frame, user engagement device, and connecting linkage being configured for performing an upper body only; and a load for resisting movement of at least one of the user support, user engagement device, and connecting linkage.

2. The machine of claim 1, wherein the user engagement device comprises first and second handles and first and second arm portions extending from the respective handles and associated with at least one of the main frame, user support frame, and connecting linkage, each arm portion being at least partially non-rigid.

3. The machine of claim 2, wherein each arm portion comprises a length of a flexible member extending from the respective handle towards at least one of the main frame, user support frame, and connecting linkage.

4. The machine of claim 3, wherein the arm portions comprise lengths of the same flexible member.

5. An upper back exercise machine, comprising:

a floor-engaging main frame having a forward end and a rear end;

a user support frame pivotally mounted relative to the main frame for rotation between exercise start and end positions;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably mounted relative to the frames for engagement by the user in performing exercises;

a connecting linkage which translates movement of the user engagement device to movement of the user support frame;

the user engagement device comprising first and second handles which are gripped and pulled by the user in performing an upper back exercise and first and second arm portions extending from the respective handles and associated with at least one of the main frame, user support frame, and connecting linkage, each arm portion comprising a length of a flexible member;

the arm portion being at least partially non-rigid to allow user-defined motion of the handle in performing an upper back exercise:

a load for resisting movement of at least one of the user support, user engagement device, and connecting linkage; and first and second independent swivel assemblies associated with at least one of the main frame, user support frame, and connecting linkage, the first length of flexible member engaging the first swivel assembly and the second length of flexible member engaging the second swivel assembly, whereby the handles can be pulled independently in paths determined by the user when performing a selected upper back exercise.

6. The machine of claim 2, wherein the arm portions are articulated.

7. The machine of claim 1, wherein the arm portion of the user engagement device is associated with both the main frame and the connecting linkage.

8. The machine of claim 1, wherein the primary support comprises a seat pad, and the end position of the seat pad is at a different angular orientation relative to the start position.

9. The machine of claim 8, wherein the seat pad is rearwardly inclined in the start position and moves from the rearwardly inclined position through a horizontal position to the forwardly inclined position during an upper back exercise.

10. An upper body exercise machine, comprising:

a floor-engaging main frame having a forward end and a rear end;

a user support frame;

a pivot assembly pivotally mounting the user support frame relative to the main frame, the pivot assembly defining a pivot axis and being configured to control rotation of the user support frame between a start position and an end position about the pivot axis, the pivot assembly defining a vertical gravitational center line of the pivotal movement of the user support frame which extends through the pivot axis;

the user support frame having at least a primary support and a secondary support for supporting spaced positions on a user's body throughout an exercise movement, the secondary support being fixed at a predetermined angular orientation relative to the primary support during the exercise movement, the primary support supporting the majority of a user's weight in the start position of the support frame;

a user engagement device movably mounted relative to one of the frames for engagement by the user in performing exercises;

a connecting linkage which translates movement of the user engagement device to movement of the user support frame;

the user engagement device comprising at least one arm portion associated with at least one of the main frame, user support frame, and connecting linkage and at least one handle connected to the arm portion which is gripped and pulled by the user in performing an upper body exercise;

at least part of the arm portion being non-rigid and configured to allow user-defined motion of the handle for selectively pulling the handle in different paths for user-selected performance of different upper body exercises; and a load for resisting movement of at least one of the user support, user engagement device, and connecting linkage.

11. The machine of claim 10, wherein the arm portion comprises at least one flexible line associated with at least one of the main frame, connecting linkage, and user support frame at a location in front of the user support frame, and at least one handle connected to the flexible line.

12. An upper body exercise machine, comprising:

a floor-engaging main frame having a forward end and a rear end;

a user support frame;

a pivot assembly pivotally mounting the user support frame relative to the main frame which allows rotation of the user support frame between a start position and an end position, the pivot assembly having at least one pivot and defining a vertical gravitational center line of the pivotal movement of the user support frame;

the user support frame having at least a primary support and a secondary support for supporting spaced positions on a user's body throughout an exercise movement, the secondary support being fixed at a predetermined orientation relative to the primary support during the exercise movement, the primary support supporting the majority of a user's weight in the start position of the support frame;

a user engagement device movably mounted relative to one of the frames for engagement by the user in performing exercises;

a connecting linkage which translates movement of the user engagement device to movement of the user support frame;

the user engagement device comprising at least one flexible member, the flexible member having first and second end portions, a first handle associated with the first end portion and a second handle associated with the second end portion, whereby a user can grip the handles on opposite sides of the user support frame and move the handles in selected paths for selective performance of different upper body exercises, the flexible member being associated with at least one of the main frame, connecting linkage, and user support frame between the end portions to allow user-defined motion of the handle for selectively pulling the handle in different paths for user-selected performance of different upper body exercises; and a load for resisting movement of at least one of the user support, user engagement device, and connecting linkage.

13. An upper body exercise machine, comprising:

a floor-engaging main frame having a forward end and a rear end;

a user support frame;

a pivot assembly pivotally mounting the user support frame relative to the main frame which allows rotation of the user support frame between a start position and an end position, the pivot assembly having at least one pivot and defining a vertical gravitational center line of the pivotal movement of the user support frame;

the user support frame having at least a primary support and a secondary support for supporting spaced positions on a user's body throughout an exercise movement the secondary support being fixed at a predetermined angular orientation relative to the primary support during the exercise movement, the primary support supporting the majority of a user's weight in the start position of the support frame;

a user engagement device movably mounted relative to one of the frames for engagement by the user in performing exercises, the user engagement device comprising at least one flexible member and at least one handle connected to the flexible member, wherein the flexible member has first and second end portions and is associated with the main frame and the connecting linkage between the end portions at a location in front of the user support frame;

a connecting linkage which translates movement of the user engagement device to movement of the user support frame; and a load for resisting movement of at least one of the user support, user engagement device, and connecting linkage.

14. The machine of claim 10, wherein the gravitational center line of the user support pivotal motion is positioned such that portions of the user support frame are distributed on each side of the gravitational center line of the pivotal motion in both the start and end position and only a portion of the user support frame passes through the gravitational center line during the exercise movement.

15. The machine of claim 14, wherein the user support frame is configured to support a user in a seated position with the user's thigh located at least approximately over a predetermined portion of the user support frame, and the gravitational center line extends through the predetermined portion of the user support frame in at least one of the start and end position of an exercise movement.

16. The machine of claim 10, wherein the user support frame is configured to support a user in a seated position facing the forward end of the frame, the primary support comprises a seat pad and the secondary support comprises an upper body engaging pad.

17. The machine of claim 16, wherein the upper body engaging pad comprises a chest pad facing towards the rear end of the frame and configured to engage a user'chest when the user is in a seated position on the seat pad facing the forward end of the frame.

18. The machine of claim 16, wherein the user support frame further comprises an additional support spaced from the primary and secondary supports and supporting a spaced position on a user's body, the additional support being fixed at a predetermined angular orientation relative to the primary and secondary supports during the exercise movement.

19. The machine of claim 18, wherein the additional support comprises a foot support for the user's feet.

20. An upper back exercise machine, comprising:

a floor-engaging main frame;

a user support frame pivotally mounted relative to the main frame for rotational movement between a start position and an end position;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably mounted relative to the frames and having at least one handle engaged by a user positioned on the user support, the user engagement device being configured to allow movement of the handle in a plurality of different user-defined paths between user-defined exercise start and end positions to perform a selected upper back exercise;

a connecting linkage associated with at least two of the main frame, user support frame, and user engagement device which translates movement of the user engagement device to movement of the user support frame; and a load for resisting movement of at least one of the user support, user engagement device, and connecting linkage.

21. The machine of claim 20, wherein the user engagement device is movably associated with the main frame.

22. The machine of claim 20, wherein the user engagement device is movably associated with the connecting linkage.

23. The machine as claimed in claim 20, wherein the user support frame supports a user in a seated position and the user engagement device has two gripping portions which are gripped and pulled by a user to perform a user-defined upper back exercise.

24. An upper back exercise machine, comprising:

a floor-engaging main frame;

a user support frame;

a pivot assembly located at least partially beneath the user support frame and pivotally mounting the user support frame relative to the main frame, the pivot assembly defining a pivot axis and being configured to control rotation of the user support frame between a start position and an end position about the pivot axis, the pivot assembly defining a vertical gravitational center line of the pivotal movement of the user support frame which extends through the pivot axis;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably mounted relative to the frames and having at least one handle engaged by the user positioned on the user support when performing an upper back exercise;

a connecting linkage associated with at least two of the main frame, user support frame, and user engagement device which translates movement of the user engagement device to movement of the user support frame;

a load for resisting movement of at least one of the user support, user engagement device, and connecting linkage; and the vertical gravitational center line of the user support pivotal motion extending through the pivot axis being positioned such that portions of the user support frame are distributed on each side of the gravitational center line of the pivotal motion in at least one of the start and end position and only a portion of the user support frame passes through the gravitational center line during the exercise movement.

25. The machine of claim 24, wherein the user support frame and the user engagement device travel in opposite directions during an exercise movement.

* * * * *